United States Patent [19]

Dijkhuizen

[11] Patent Number: 4,563,782

[45] Date of Patent: Jan. 14, 1986

[54] HYDROPNEUMATIC MASSAGE BATH

[75] Inventor: Okko K. Dijkhuizen, Roden, Netherlands

[73] Assignee: B. E. M. Wientjes B.V., Roden, Netherlands

[21] Appl. No.: 563,926

[22] Filed: Dec. 21, 1983

[30] Foreign Application Priority Data

Jan. 4, 1983 [NL] Netherlands ..... 8300018

[51] Int. Cl.[4] ..... A61H 33/02

[52] U.S. Cl. ..... 4/542; 4/492; 4/541

[58] Field of Search ..... 4/491–492, 4/541–542; 239/270, 419.5, 585; 128/66

[56] References Cited

U.S. PATENT DOCUMENTS

| | | | |
|---|---|---|---|
| 3,541,616 | 11/1970 | Stricker | 4/542 |
| 3,571,820 | 3/1971 | Jacuzzi | 4/542 |
| 3,708,125 | 1/1973 | Patterson | 239/428.5 |
| 3,846,848 | 11/1974 | McNair | 261/36 R |
| 3,946,449 | 3/1976 | Mathis | 4/542 |
| 4,197,815 | 4/1980 | Brazelton | 4/491 |
| 4,220,145 | 9/1980 | Stamp et al. | 4/542 X |
| 4,262,371 | 4/1981 | Berry et al. | 4/542 X |
| 4,320,541 | 3/1982 | Neenan | 4/492 |
| 4,419,775 | 12/1983 | Ebert | 4/542 |
| 4,420,846 | 12/1983 | Bonner | 4/542 |
| 4,460,519 | 7/1984 | Leggett | 4/542 |
| 4,475,690 | 10/1984 | Hascher-Reichl et al. | 239/585 |

*Primary Examiner*—Henry K. Artis

*Attorney, Agent, or Firm*—Wenderoth, Lind & Ponack

[57] ABSTRACT

A hydropneumatic massage bath includes a bath tub having high side walls and a bottom and at least one pressurized-water line that terminates in a water jet nozzle. An air supply line opens into a chamber surrounding the water jet nozzle. Such chamber has an outlet orifice for a jet of water and pressurized air entering the interior of the bath tub structure is provided for pulsating the jet of water/air mixture that discharges into the interior of the bath tub. To achieve a pleasant and variable massaging effect, as well as to reduce the susceptibility of the system to contaminants and compressive stress, an interrupt mechanism is arranged in the air supply line upstream of the chamber to fully or partially close the air supply at a desired pulsation frequency, thereby controlling the flow of incoming air into the chamber.

7 Claims, 2 Drawing Figures

HYDROPNEUMATIC MASSAGE BATH

BACKGROUND OF THE INVENTION

The invention relates to a hydropneumatic massage bath including a bath tub having high side walls and a bottom and at least one pressurized-water line that terminates in a water jet nozzle, with an air supply line which opens into a chamber surrounding the water jet nozzle, the chamber having an outlet orifice for the jet of water and air entering the bath tub interior, as well as means for pulsating the jet of water/air mixture that discharges into the bath tub interior.

Such a massage bath has been known, as exemplified in West German Pat. No. 27 35 578, in the form of a massage cabin, wherein a pressurized-air line opens into the chamber surrounding the water jet nozzle and the free end of which is connected to a radial forced-draft fan provided with a speed regulator. The chamber has an auxiliary nozzle with a reduced outlet orifice so that the chamber is constructed as a compression chamber in order to precompress the escaping pressurized water together with incoming pressurized air. As a result, the water/air mixture is pressurized rhythmically and intermittently into the collecting basin of the massage cabinet interior and is not injected continuously. However, this system leads to an unsatisfactory massaging effect.

U.S. Pat. No. 4,320,541 discloses a method and apparatus for producing a pulsating air/water jet, wherein the pulsating effect of the massaging jet is achieved by repeatedly moving a distrubance body into and from the water jet issuing from the water jet nozzle. This is designed to temporarily reduce the Venturi effect of the water jet nozzle in the chamber. However, this solution has the disadvantages that it has components susceptible to breakdown that move in the water flow, the pulsation of the massaging jet cannot be controlled with an adequate degree of accuracy, and the disturbance of the water jet discharging from the water jet nozzle reduces the effectiveness of the massaging jet.

SUMMARY OF THE INVENTION

It is the primary object of the invention to improve the massaging effect of a similar type of hydropneumatic massage bath.

According to the teachings of the invention, this object is achieved by placing in the air supply line upstream of the chamber an interrupter mechanism that can be closed completely or partially in order to control the incoming air flowing into the chamber. This results in an accurate control of the pulsation frequency. The water jet nozzle surrounded by the chamber produces a Venturi effect, so that air from the air supply line is drawn into the chamber and is entrained by the water jet issuing from the water jet nozzle. The jet of water-/air mixture produces a pleasant massaging effect upon the user. This massaging effect resulting from the teachings of the invention for producing the pulsation of the massaging jet is very reliable and pleasant because, as a result of the pulsewise interruption of the air supply, a pulsewise rather strongly reduced atmospheric pressure is generated in the chamber by the water jet issuing from the water jet nozzle and which has an effect upon the massaging jet. Thus, the hydropneumatic massage bath of the invention is also substantially more effective, more pleasant, and less susceptible to breakdown than the devices in which the supply to the Venturi nozzle is interrupted by means of a valve mechanism or a disturbing body, because such valves in the pressurized-water line or such disturbance bodies are relatively sensitive to impurities. Moreover, the interruption of the water supply and the disturbance of the water jet result in water hammer effects in the water supply pump. Also, by making use of the solution advocated by the invention, the pulsation effect and thereby the massaging effect can be better controlled, independently of the strength of the water supply.

The interrupter mechanism can be so designed that the flow of incoming air is completely stopped with the desired pulsation frequency. It is also possible, however, to vary the flow of incoming air with the pulsation frequency from a maximum valve to a minimum value other than zero. Both the maximum value and the minimum valve of the air supply can be adjusted. By alternately opening the air supply line completely or partially, a fluctuating subatmospheric pressure arises in the chamber surrounding the water jet nozzle, so that the strength of the jet of water/air mixture issuing from the chamber also fluctuates. The massaging effect can be modified further and can be so adjusted as to create the most pleasant sensation if the pulsation frequency of the interrupter mechanism is controllable. Therefore, by means of the interrupter mechanism both the pulsation strength and the pulsation frequency of the jet of water/air mixture can be varied in such a way that the operating frequency of the interrupter mechanism and-/or the aperture of the air supply line can be varied.

Preferably, the interrupter mechanism has a regulator valve that is, for example, designed as a magnetic valve.

An actuating mechanism can be assigned to the regulator valve of the interruptor mechanism and which is capable of adjusting both the opening frequency and the size of the aperture of the regulator valve. If, according to another embodiment of the invention, the air supply is connected to the discharge line of an air compressor, then the pressure introduced with the air supply line into the chamber can be varied and, thereby, also the massaging effect. Otherwise, the air supply line only draws in ambient air under atmospheric pressure. In the event the air supply line is connected to the discharge line of an air compressor, the interrupter mechanism, particularly the regulator valve, should be designed for the regulation of a flow of pressurized air and it should be possible to adjust its pulsation frequency and aperture.

Advantageously, the pressurized-water line is connected to the discharge of a water circulating pump to eliminate the need for the supply and discharge of new water.

It is of particular advantage to connect the suction side of the circulating pump to the interior of the bath tub so that the water needed for the hydropneumatic massage bath is drawn from the bath water in the bath tub itself and is resupplied through the water jet nozzle.

One or more water jet nozzles with their chamber or chambers can be arranged in or on the walls of the bath tub, so that the person in the bath tub is exposed to a massaging action, at his option, by one Venturi nozzle or all around by a plurality of Venturi nozzles.

BRIEF DESCRIPTION OF THE DRAWINGS

Further objects, features, advantages and application possibilities of the present invention will become apparent from a consideration of the ensuing description of a specific embodiment, with reference to the accompanying drawings, are features described and/or illustrated forming the subject matter of the present invention either alone or in any meaningful combination, wherein.

DETAILED DESCRIPTION OF THE INVENTION

Figure 1:
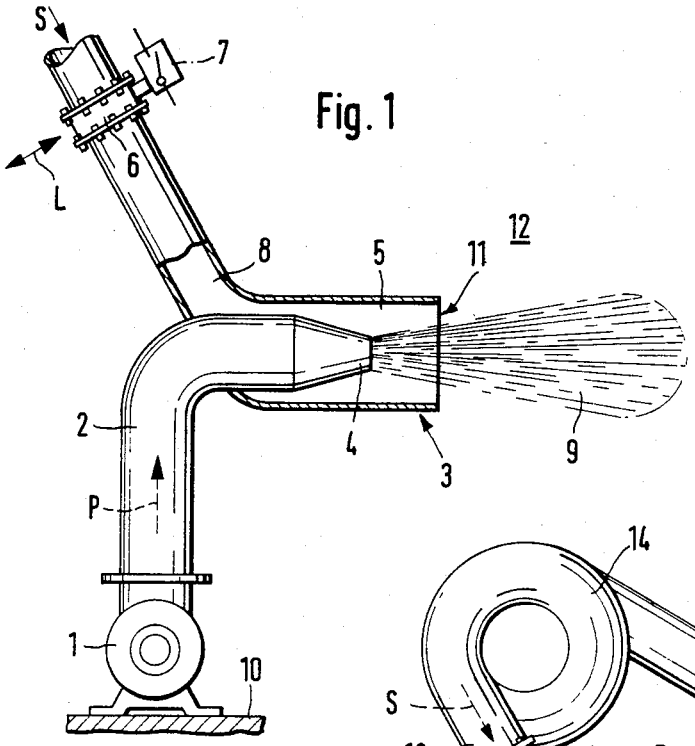
FIG. 1 is a schematic view of a system of a hydropneumatic massage bath of the invention in the area of the water jet nozzle and a chamber, wherein an air supply line draws air from the environment.

The system 1 shown in FIG. 1 has a water circulating pump 1 attached, for example, to a bath tub 10 and drawing water from the bath tub interior 12, and delivering it to a pressurized-water line 2 in the direction of arrow P. Pressurized-water line 2 opens into a water jet nozzle 4. Water jet nozzle 4 has a front end extended into a cylindrical member forming a chamber 5 which surrounds water jet nozzle 4 spaced a predetermined radial distance therefrom. Therefore, water jet nozzle 4 and chamber 5 together form a water jet/air ejector means 3 that operates according to the Venturi principle. To this end, chamber 5 is provided with a front outlet orifice 11. An air supply line 8 opens into the rear end of chamber 5. Under the influence of the subatmospheric pressure generated by the water jet in chamber 5 issuing from water jet nozzle 4, air is drawn into chamber 5 in the direction of arrow S through air supply line 8.

According to the invention, there is provided in air supply line 8 a regulator valve 6 having an air port can be varied in size by movement in the direction of arrow L, so that the quantity of air that can be drawn into air supply line 8 is adjustable. Further, there is assigned to valve 6 an actuating mechanism 7 which, depending on the setting of regulator valve 6, is either opened fully or partially or closed fully or partially with a pulsation frequency which is thus communicated to the jet 9 of water/air mixture issuing from outlet orifice 11 and arriving in the bath water. The pulsation frequency of actuating mechanism 7 is also controllable. Because of the adsorption of varying quantities of air, the jet 9 of water/air mixture arriving in the bath water produces a pulsating flow which gives rise to a pleasant massaging effect. The quantity of water delivered per unit time through water jet nozzle 4 remains essentially constant during the massaging operation. Only at the start of the massaging operation is the quantity of water set at the desired value, and the supply of water is stopped at the end of the massaging operation. The massaging effect is set at a value that provides the most pleasant sensation to the user through control of the pulsation frequency of actuating mechanism 7 and of the aperture of regulator valve 6.

Figure 2:
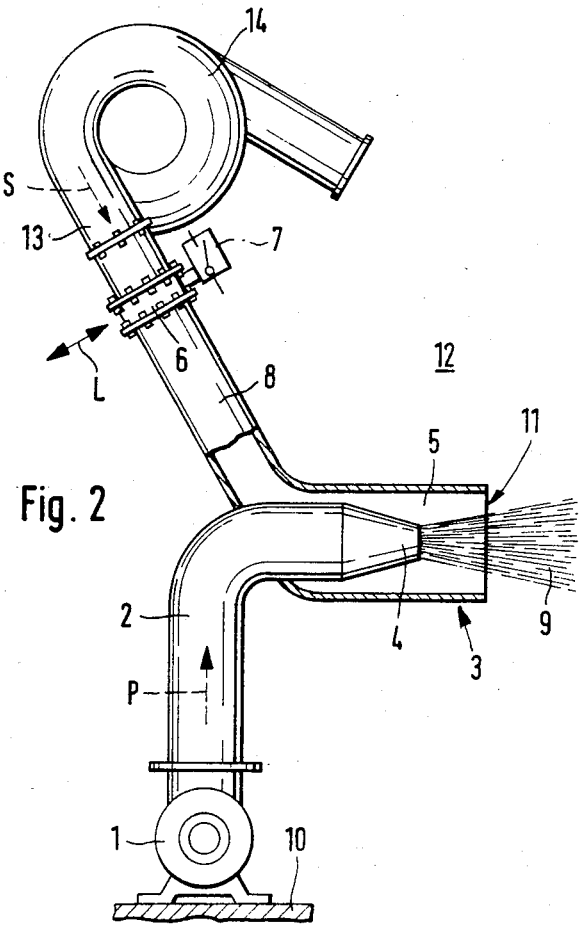
FIG. 2 is a view similar to FIG. 1, but of a system wherein the air supply line is supplied with pressurized air by means of an air compressor.

The system depicted in FIG. 2 differs from that of FIG. 1 in that the air supply line 8 not only draws in ambient air but is also supplied through discharge line 13 of an air compressor 14 with air that is compressed at a pressure above atmospheric pressure. This results in another possibility of varying the massaging effect of the jet 9 of water/air mixture.

I claim:

1. A hydropneumatic massage bath comprising:

a bath tub having high side walls, a bottom and an interior;

at least one pressurized water line having an outlet end terminating in a water jet nozzle for discharging water under pressure;

a member surrounding said outlet end of said water line and defining therewith a chamber, said member having an inlet end connected to an air supply line, such that discharge of said water under pressure from said nozzle creates a reduced pressure in said chamber surrounding said outlet end of said water line and draws air through said air supply line into said chamber to thereby form an air/water mixture, and said member having an outlet end with an orifice for discharging said air/water mixture into said interior of said bath tub; and interrupter means, in said air supply line at a position upstream of said inlet end of said member, for partially or completely closing said air supply line at a desired frequency and thereby for supplying said air to said chamber in controlled pulsations at said frequency.

2. A massage bath as claimed in claim 1, wherein said interrupter means includes a magnetic regulator valve.

3. A massage bath as claimed in claim 2, wherein said interrupter means further includes an actuating mechanism operably connected to said regulator valve.

4. A massage bath as claimed in claim 1, wherein said air supply line is connected to the discharge line of an air compressor.

5. A massage bath as claimed in claim 1, wherein said pressurized water line is connected to the discharge of a water circulating pump.

6. A massage bath as claimed in claim 5, wherein the suction side of said water circulating pump is connected to said bath tub interior.

7. A massage bath as claimed in claim 1, wherein a plurality of said water jet nozzles and respective chambers are arranged in or on said walls of said bath tub.

* * * * *